US007584724B2

(12) United States Patent
Berger

(10) Patent No.: US 7,584,724 B2
(45) Date of Patent: Sep. 8, 2009

(54) VARIABLE COMPRESSION RATIO DUAL CRANKSHAFT ENGINE

(75) Inventor: Alvin H. Berger, Brownstown, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 84 days.

(21) Appl. No.: 11/928,047

(22) Filed: Oct. 30, 2007

(65) Prior Publication Data

US 2009/0107139 A1 Apr. 30, 2009

(51) Int. Cl.
*F02B 75/04* (2006.01)

(52) U.S. Cl. ..... 123/48 R; 123/51 R; 123/78 R

(58) Field of Classification Search ..... 123/48 R, 123/48 B, 51 R–51 BD, 78 R, 78 F
See application file for complete search history.

(56) References Cited

U.S. PATENT DOCUMENTS

| | | | | | |
|---|---|---|---|---|---|
| 952,706 | A | | 3/1910 | Lucas | |
| 1,221,094 | A | | 4/1917 | Roth | |
| 1,383,367 | A | | 7/1921 | Wygodsky | |
| 2,137,941 | A | * | 11/1938 | Helmore et al. | 123/78 R |
| 2,255,773 | A | | 9/1941 | Heftler | |
| 2,506,512 | A | | 5/1950 | Mallory | |
| 2,858,816 | A | | 11/1958 | Prentice | |
| 3,304,923 | A | | 2/1967 | Parenti | |
| 3,961,607 | A | * | 6/1976 | Brems | 123/78 R |
| 4,010,611 | A | | 3/1977 | Zachery | |
| 4,092,957 | A | | 6/1978 | Tryhorn | |
| 4,375,792 | A | | 3/1983 | Barret | |
| 4,509,474 | A | | 4/1985 | Schmuck | |
| 4,876,992 | A | * | 10/1989 | Sobotowski | 123/48 R |
| 5,638,777 | A | * | 6/1997 | Van Avermaete | 123/52.4 |
| 6,230,671 | B1 | | 5/2001 | Achterberg | |
| 6,318,309 | B1 | | 11/2001 | Burrahm et al. | |

FOREIGN PATENT DOCUMENTS

| | | |
|---|---|---|
| DE | 3412662 | 10/1985 |
| JP | 2004-11546 | 1/2004 |

* cited by examiner

*Primary Examiner*—Noah Kamen
(74) *Attorney, Agent, or Firm*—Dickinson Wright PLLC; Julia Voutyras

(57) ABSTRACT

A synchronized, dual crankshaft engine (10) uses a phase-shifting device (42) to alter the angular position of one crankshaft (12) relative to the other crankshaft (14) for dynamically varying the engine's developed compression ratio. Each crankshaft (12, 14) drives a respective connecting rod (16, 18) which, in turn, reciprocates a piston (24, 26) in a cylinder (28, 30). The center lines (C, D) of each cylinder (28, 30) are skewed relative to each other so that the pistons (24, 26) converge toward a common combustion chamber formed under a common cylinder head (34). Movable exhaust valves (36) are located above the piston (24) whose phase shifted orientation is retarded or lagging dead center conditions, whereas movable intake valves (38) are located above the piston (26) that is leading or advanced in its phase displacement relative to dead center conditions.

15 Claims, 13 Drawing Sheets

60°Deg. Phase Shift
Compression Ratio: 7.0:1

VARIABLE COMPRESSION RATIO DUAL CRANKSHAFT ENGINE

CROSS REFERENCE TO RELATED APPLICATIONS

None.

BACKGROUND OF THE INVENTION

1. Field of the Invention

The subject invention relates generally to a variable compression ratio engine in which the compression ratio in the combustion chamber of an internal combustion engine is adjusted while the engine is running, and more specifically toward a synchronized, dual crankshaft engine that uses a phase-shifting device to alter the angular position of one crankshaft relative to the other for dynamically varying the engine compression ratio.

2. Related Art

Gasoline engines have a limit on the maximum pressure that can be developed during the compression stroke. When the fuel/air mixture is subjected to pressure and temperature above a certain limit for a given period of time, it autoignites rather than burns. Maximum combustion efficiency occurs at maximum combustion pressures, but in the absence of compression-induced autoignition that can create undesirable noise and also do mechanical damage to the engine. When higher power outputs are desired for any given speed, more fuel and air must be delivered to the engine. To achieve greater fuel/air delivery, the intake manifold pressure is increased by an additional opening of a throttle plate or by the use of turbochargers or superchargers, which also increase the engine inlet pressures. For engines already operating at peak efficiency/maximum pressure, however, the added inlet pressures created by turbochargers or superchargers would over compress the combustion mixtures, thereby resulting in autoignition, often called knock due to the accompanying sound produced. If additional power is desired when the engine is already operating with combustion pressures near the knock limit, the ignition spark timing must be retarded from the point of best efficiency. This ignition timing retard results in a loss of engine operating efficiency and also an increase of combustion heat transferred to the engine. Thus, a dilemma exists: the engine designer must choose one compression ratio for all modes. A high compression ratio will result in optimal fuel efficiency at light load operation, but at high load operation, the ignition spark must be retarded to avoid autoignition. This results in an efficiency reduction at high load, reduced power output, and increased combustion heat transfer to the engine. A lower compression ratio, in turn, results in a loss of engine efficiency during light load operation, which is typically a majority of the operating cycle.

To avoid this undesirable dilemma, the prior art has taught the concept of dynamically reducing an engine compression ratio whenever a turbocharger or supercharger is activated to satisfy temporary needs for massive power increases. Thus, using variable compression ratio technology, the compression ratio of an internal combustion engine can be set at maximum, peak pressures in non-turbo/super charged modes to increase fuel efficiency while the engine is operating under light loads. However, in the occasional instances when high load demands are placed upon the engine, such as during heavy acceleration and hill climbing, the compression ratio can be lowered, on the fly, to accommodate an increase in the inlet pressure caused by activation of a turbocharger or supercharger. In all instances, compression-induced knock is avoided, and maximum engine efficiencies are maintained.

Various attempts to accomplish dynamic variable compression ratios in an internal combustion engine have been proposed. For example, the automobile company SAAB introduced a variable compression ratio engine concept in U.S. Pat. No. 5,329,893. The SAAB concept consisted of a cylinder block and cylinder head assembly connected by a pivot to a separate crankshaft/crankcase assembly, so that a small (e.g., 4°) relative movement was permitted, which movement was controlled by a hydraulic actuator. The SAAB mechanism enabled the distance between the crankshaft center line and the cylinder head to be varied.

Other attempts to accomplish dynamic variable compression ratios have included the operation of synchronized, dual crankshaft engines, wherein the synchronized crankshafts are supported for rotation about parallel axes with their pistons working directly against each other in a common cylinder. Among these so-called "headless" designs which favor opposing pistons working against each other from opposite ends of the same cylinder bore, some are proposed in which the phase relationship of the synchronized crankshafts can be adjusted so that both pistons do not reach top dead center at the same instant. The result is an ability to vary the compression ratio developed by the engine. Examples of synchronized, dual crankshaft engines with phase adjusters may be found in U.S. Pat. No. 6,230,671 to Achterberg, issued May 15, 2001, and U.S. Pat. No. 4,092,957 to Tryhorn issued Jun. 6, 1978, and 4,010,611 to Zachery issued Mar. 8, 1977, and U.S. Pat. No. 2,858,816 to Prentice, issued Nov. 4, 1958.

A particular shortcoming in all prior art attempts to dynamically vary the engine compression ratio by phase-shifting the synchronization of dual crankshafts is the mechanically cumbersome challenge of coupling two crankshafts oriented on polar opposite sides of an engine. Practically speaking, phasing two crank shafts spaced so far apart is very difficult. This leads to complicated and ineffectual mechanisms and designs which are not well suited to today's high efficiency engines and demanding customer expectations. Furthermore, the prior art "headless" designs, in which opposing pistons work against each other from opposite ends of the same cylinder bore, do not readily accommodate the traditional poppet valve nor the time-tested techniques for seating and guiding valves in an internal combustion engine. Thus, gas flow control methods must be employed in such prior art engines at the sacrifice of dependability and economy. And yet again, phase-shifting of dual crankshafts results in a need to vary the timing of gas flow events to conform to "effective" top and bottom dead center timing. The prior art designs significantly complicate any attempts to properly time gas flow events in these complex circumstances. And still further, a primary reason to vary an engine's compression ratio is to take full advantage of turbo- or supercharging systems for high demand conditions. The prior art dual crankshaft engines that enable phase-shifting are notoriously unfriendly to the incorporation of traditional turbo- and super-charging systems that cooperate with the gas flow control system.

Accordingly, there is a need for an improved variable compression ratio engine which enables adjustment of combustion compression ratios on the fly, which is not frustrated by mechanical complexities, and which enables use of more traditional, time-tested valve train and turbo/super-charging techniques.

The two parallel axes crankshafts can be coupled to each other to operate with the same hand, or opposite hands of rotation. Either configuration could be used to achieve the variable compression ratio function, but the configuration that has the crankshafts rotate opposite to each other has the advantage of reduced torsional vibration of the engine assembly. This art is taught in U.S. Pat. No. 2,255,773, to Heftler issued Sep. 16, 1941.

SUMMARY OF THE INVENTION

The subject invention overcomes the disadvantages and shortcomings found in the prior art by providing a dual crankshaft engine, wherein the crankshafts are supported for rotation about respective parallel axes. Each combustion chamber comprises first and second cylinders. Each cylinder is associated with a different one of the crankshafts. A piston is disposed for reciprocating movement in each of the first and second cylinders. A connecting rod pivotally connects at an upper end thereof to each piston and at an opposite, lower end thereof to a respective one of the crankshafts. A common cylinder head communicates simultaneously with the first and the second cylinders. The cylinder head includes at least one movable intake valve and one movable exhaust valve along with at least one spark plug. A phasing device interconnects the crankshafts for synchronized rotation at identical speeds in the same or in opposite angular directions. The phasing device is selectively operable to temporarily interrupt synchronized rotation so as to change the angular position of one crankshaft relative to the other crankshaft, and then to resume synchronized rotation with the crankshafts in a new, phase-shifted condition relative to each other. Whereby, the phasing device can dramatically vary the compression ratio developed by the engine by altering the phase shift between the synchronized crankshafts.

Thus, the subject invention, which utilizes a common cylinder head, has the advantage of substantially simplifying the mechanical linkages and couplings which wed the two crankshafts together for synchronized rotation at identical speeds in the same or opposite angular directions. Furthermore, the common cylinder head supports intake and exhaust valves therein, together with a spark plug, to facilitate the use of traditional, time tested valve train and turbo/super-charging techniques.

According to another aspect of this invention, a method is provided for varying the compression ratio of an internal combustion engine having dual crankshafts supported for rotation about respective parallel axes. The method comprises the steps of providing first and second cylinders, each cylinder associated with a different crankshaft. A pair of pistons is provided, with one piston disposed in each of the first and second cylinders for reciprocating movement. The method includes pivotally connecting each piston to a respective one of the crankshafts with a connecting rod so that the piston reciprocates a full up and down stroke in its respective cylinder with each crankshaft revolution. The first and second cylinders communicate with a common cylinder head so that combustion gases flow freely between the first and second cylinders. At least one intake valve and one exhaust valve are movably supported in the cylinder head, together with at least one spark plug. The method further includes synchronizing the crankshafts for identical speed rotation in the same or opposite angular directions. The synchronized rotation step is temporarily interrupted, at calculated times, to change the angular position of one crankshaft relative to the other crankshaft. And the method includes resuming the step of synchronizing rotation of the crankshafts in a new, phase-shifted condition relative to each other, whereby the steps of temporarily interrupting and resuming can be used to selectively, dynamically, vary the compression ratio developed by the engine by altering the phase relationship between the synchronized crankshafts.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
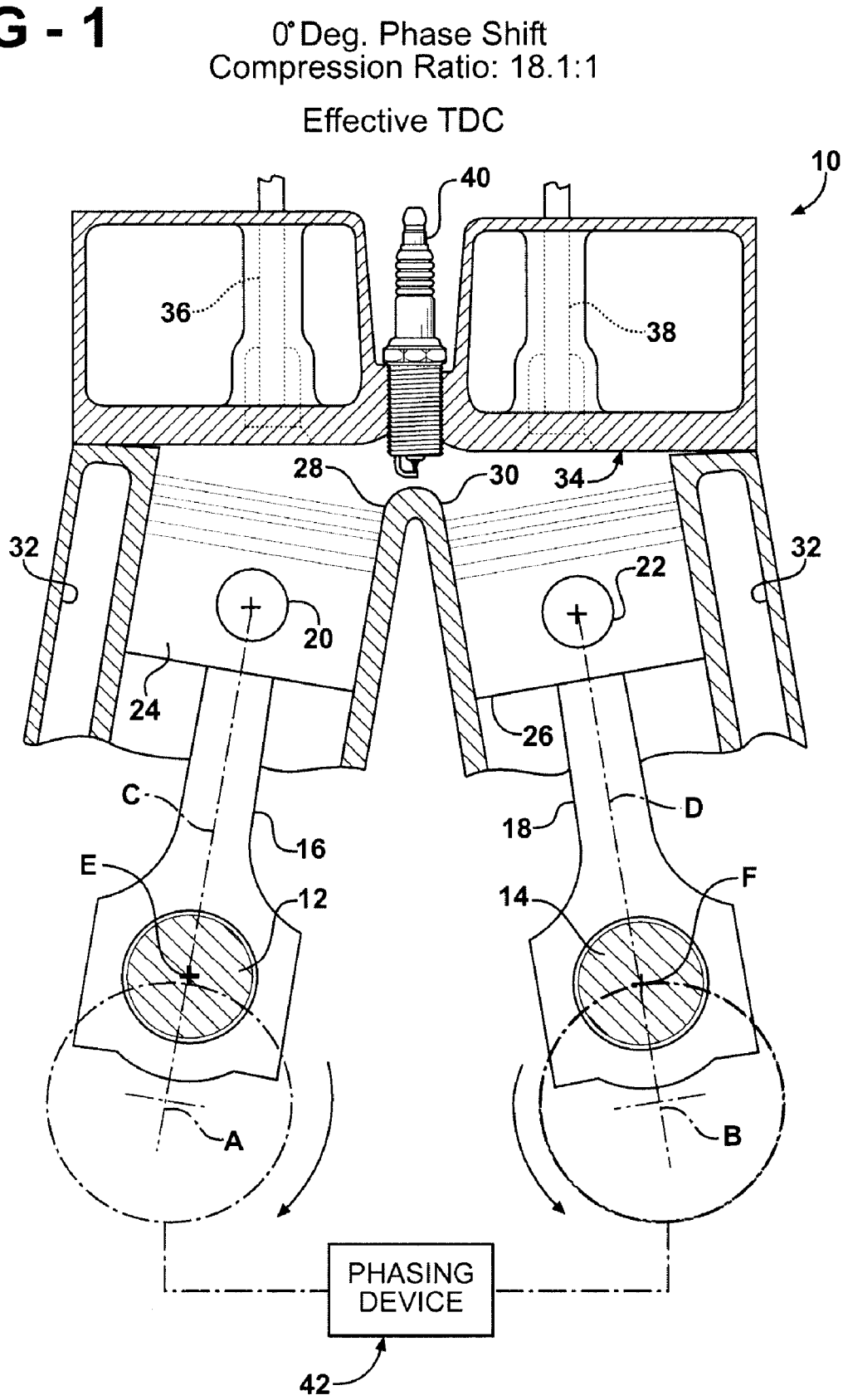
FIG. 1 is a schematic, cross-sectional view of a dual crankshaft internal combustion engine according to one embodiment of this invention, wherein the crankshafts are set at zero degrees phase shift resulting in the highest possible developed compression ratio.

Referring to the Figures, wherein like numerals indicate like or corresponding parts throughout the several views, a schematic representation of an engine according to one exemplary embodiment of this invention is generally shown at 10 in FIG. 1. The engine 10 is of the dual crankshaft-type, wherein two crankshafts 12, 14 are supported for rotation about respective parallel axes A, B. The crankshafts 12, 14 may be of the typical type, supported in main bearings (not shown) in an engine crankcase assembly. A connecting rod 16, 18 is pivotally connected at a lower end thereof to each crankshaft 12, 14, respectively. This pivoting connection can be accomplished with standard techniques. An upper end of each connecting rod 16, 18 carries a pin 20, 22, respectively, for articulated connection to a piston 24, 26, respectively. The one piston 24 is disposed for reciprocating movement in a first cylinder 28, whereas the other piston 26 is similarly disposed for reciprocating movement in a second cylinder 30. Thus, as the crankshafts 12, 14 rotate about their respective axes A, B, the associated connecting rods 16, 18 are moved through a general plane motion to stroke each piston 24, 26 between a top dead center position (shown in FIG. 1) and a bottom dead center (not shown).

In the exemplary embodiment of this invention as depicted schematically in FIG. 1, the outer portions of the cylinders 28, 30 are cooled with a water jacket passage 32. Those of skill in the art will appreciate other constructions and arrangements, however. The first 28 and second 30 cylinders are covered at their uppermost end by a common cylinder head, generally indicated at 34. The cylinder head 34 communicates simultaneously with the first 28 and second 30 cylinders to create a common combustion chamber there between. The cylinder head 34 may be of a somewhat traditional design, including movable poppet-style exhaust 36 and intake 38 valves. A spark plug 40 is also carried in the cylinder head 34 in typical fashion. The intake valve 38 communicates with an intake manifold or other fuel and air injection system to conduct fresh mixtures of fuel and air into the combustion chamber. The exhaust valve 36 opens during an exhaust cycle of the engine 10 for expelling burnt gasses.

Each of the first 28 and second 30 cylinders are formed along respective, longitudinally extending center lines C, D, respectively. The center line C of the first cylinder 28 perpendicularly intersects the rotational axis A of the first crankshaft 12. similarly, the longitudinal center line D of the second cylinder 30 extends perpendicularly through the second crankshaft axis B in the manner illustrated in FIG. 1. These cylinder center lines C, D represent the imaginary central axes of substantially cylindrically bored walls of each cylinder 28, 30. The pistons 24, 26 are thus centered along the respective center lines C, D for reciprocating movement in parallel with the center lines C, D.

When viewed from FIG. 1, the spacing between the cylinder center lines C, D is seen to vary as a function of distance from the crankshaft axes A, B. This spacing is the greatest adjacent the crankshaft axes A, B, and diminishes in the direction projected toward the cylinder head 34. Thus, in the preferred embodiment of the subject engine 10, the cylinder center lines C, D are not collinear, as would be expected in an opposed cylinder arrangement, nor are they parallel as some engine configurations in the prior art may propose. Rather, the skewed nature of the cylinder center lines C, D form something of an inverted V-type engine, where the pistons 24, 26 actually converge toward the common, centrally located cylinder head 34.

Figure 1A:
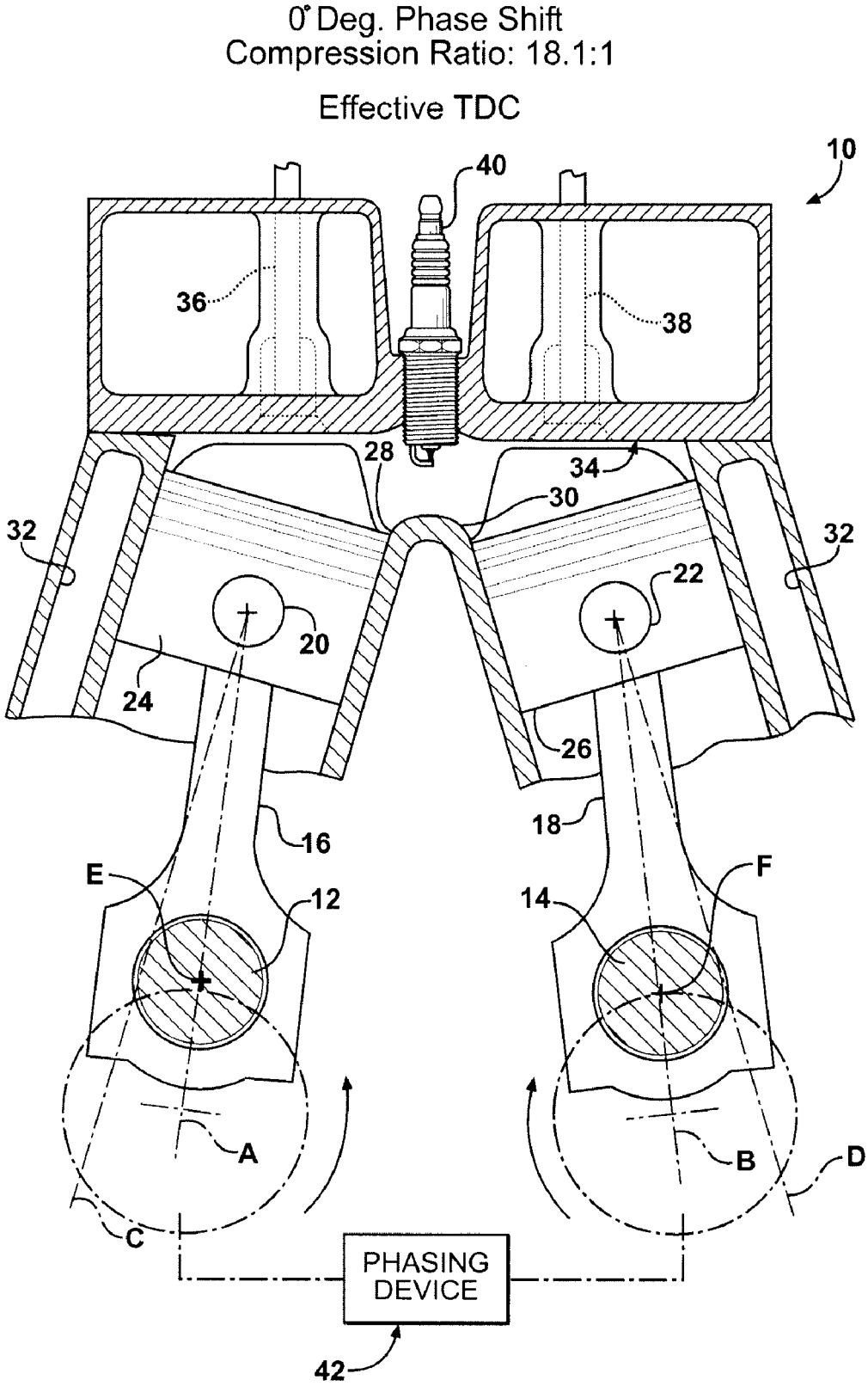
FIG. 1A is a view as in FIG. 1 but depicting an offset of the cylinder bore axes outside the crankshaft rotational axes.

An alternative embodiment is to offset the cylinder bore axes C, D from their respective crankshaft rotational axes A, B to reduce friction resulting from the pistons' side load against the cylinder walls during the power stroke. This crankshaft to cylinder bore offset is taught by U.S. Pat. No. 6,058,901 to Lee, issued May 9, 2000. If the cylinder bore axes to crankshaft rotational axes offsets are achieved by moving the bottoms of the cylinder bores farther apart from each other as illustrated in FIG. 1A, the shape of the combustion chamber changes, to increase the cross sectional flow area between the two cylinders. This increased area, shown immediately below the spark plug 40 in FIG. 1A, reduces the pumping losses incurred as gasses flow from one cylinder to the other, but it also increases the combustion chamber's minimum volume and thus decreases the maximum achievable compression ratio. Piston "pop-ups", material added to the top surfaces of the pistons can be used to increase the maximum achievable compression ratio. It should be noted that for this feature of cylinder bore axes to crankshaft rotational axes offset to effect a reduction of engine friction, the crankshafts must have rotational directions that maintain the connecting rod axes more closely parallel to the cylinder bore axes during the expansion stroke than during the compression stoke.

Figure 1B:
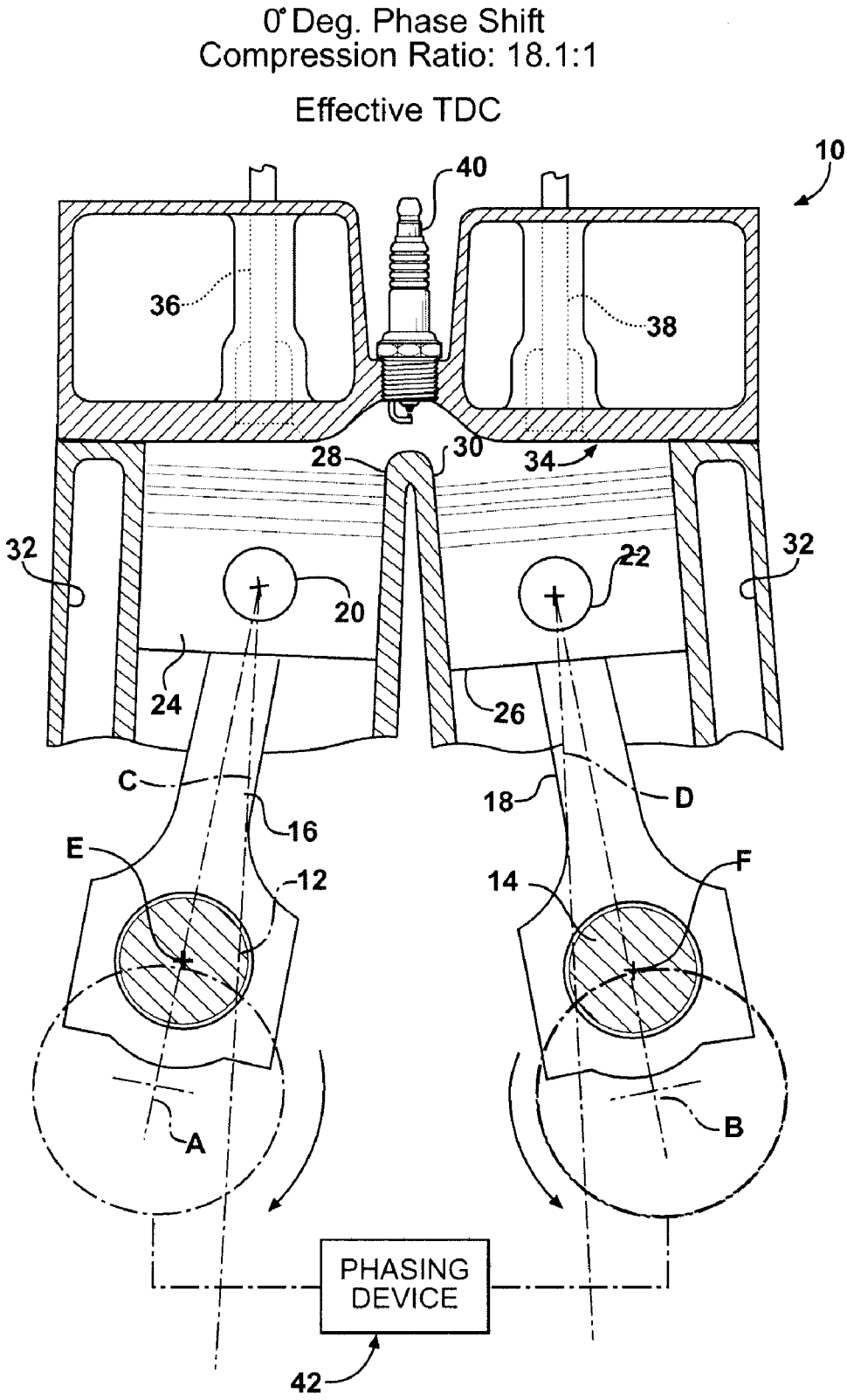
FIG. 1B is a view as in FIG. 1 but depicting an offset of the cylinder bore axes inside the crankshaft rotational axes.

If the cylinder bore axes C, D are offset by moving the bottoms of the cylinder bores inwards toward each other, as illustrated in FIG. 1B, the flow area between the two cylinders is reduced, but a portion of the cylinder head, however, can be recessed as needed to provide flow area for the combustion gasses. Again, the directions of crankshaft rotations must be appropriate for reducing piston side loading during the power strokes.

Each connecting rod 16, 18 is rotationally connected to its respective crankshaft 12, 14 through the typical rod bearing which is not clearly discerned in the figures. Nevertheless, a rotational axis E, F is established between the lower end of each connecting rod 16, 18 and its respective crankshaft 12, 14, which rotational axis E, F is spaced from the respective crankshaft axis A, B as represented by the circumscribing broken line in FIG. 1. Of particular importance to this invention are the so-called "dead center" conditions defined as the moment at which each piston 24, 26 reaches the upper or lower limit of its travel within its respective cylinder 28, 30. In the illustrations of FIGS. 1, 1A, & 1B, a top dead center condition is illustrated, whereby the rod bearing centers E, F simultaneously coincide with the lines connecting each piston pin 20, 22 with the axis of its respective crankshaft A, B. In this dual crankshaft engine 10 example, wherein both pistons 24, 26 reach their maximum stroke, i.e., top dead center, position at the same instant, the maximum engine compression ratio is achieved. In other words, when there is no phase shifting between the first 12 and second 14 crankshafts such that both pistons 24, 26 are at their full up position at the same moment, the highest possible compression ratio for the engine 10 will occur. In the example which will be used throughout the remainder of this description, if each cylinder 28, 30 and piston 24, 26 combination is capable of sweeping a volume of 583 cubic centimeters, and if the total clearance volume above the pistons 24, 26 at top dead center is assumed to be 34 cubic centimeters, then a theoretical total compression ratio of 18.1:1 can be achieved.

Figure 2:
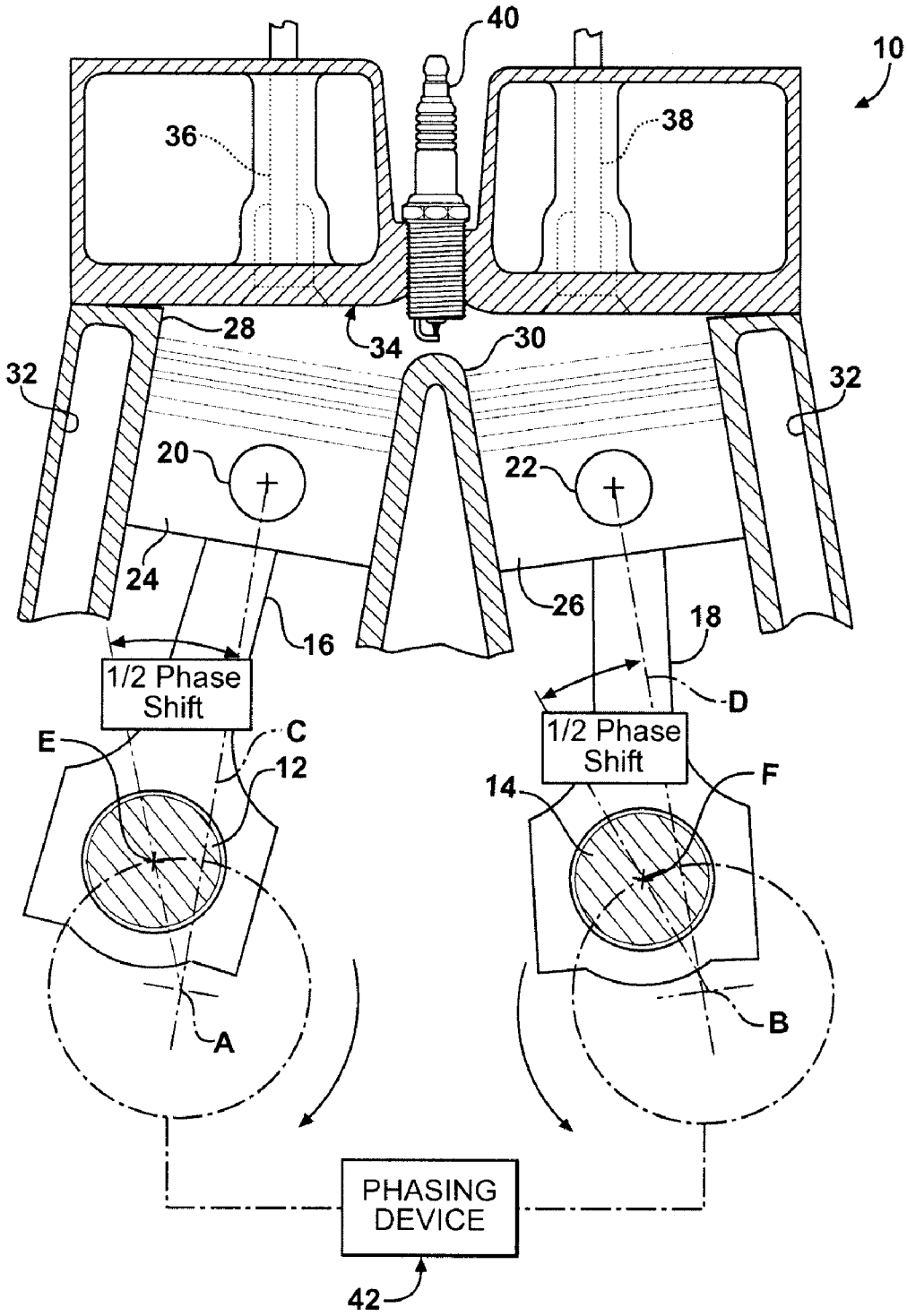
FIG. 2 is a view as in FIG. 1 but depicting the crankshafts offset from each other by a combined 30 degree phase shift resulting in a decrease in the developed engine compression ratio.

However, if, as shown in FIG. 2, the synchronized rotation of the crankshafts 12, 14 is interrupted temporarily so that a change in the angular position of one crankshaft relative to the other is introduced, and then synchronized rotation resumed in a new, phase-shifted condition relative to each other, the compression ratio developed by the engine 10 will be altered. In the example of FIG. 2, a 30 degree phase-shifted condition is illustratively depicted. Some graphical exaggeration may be introduced in FIG. 2 for emphasis. Thus, comparing the rod bearing center lines E, F relative to their respective cylinder center lines C, D, it is shown that a 30 degree phase shift, as an example, is represented by a 15 degree phase shift in each crank assembly. That is, the 30 degree phase shift is defined by the rod bearing center E of the first cylinder 28 being retarded from its top dead center orientation by 15 degrees, and the rod bearing center F for the second cylinder 30 is advanced 15 degrees relative to its cylinder center line D.

The partial phase shifts for each crank assembly combine to yield an effective 30 degree phase shift. Using the same engine specifications and parameters defined above, this 30 degree phase shift results in a reduction of the developed engine compression ratio down to 13.1:1.

Figure 3:
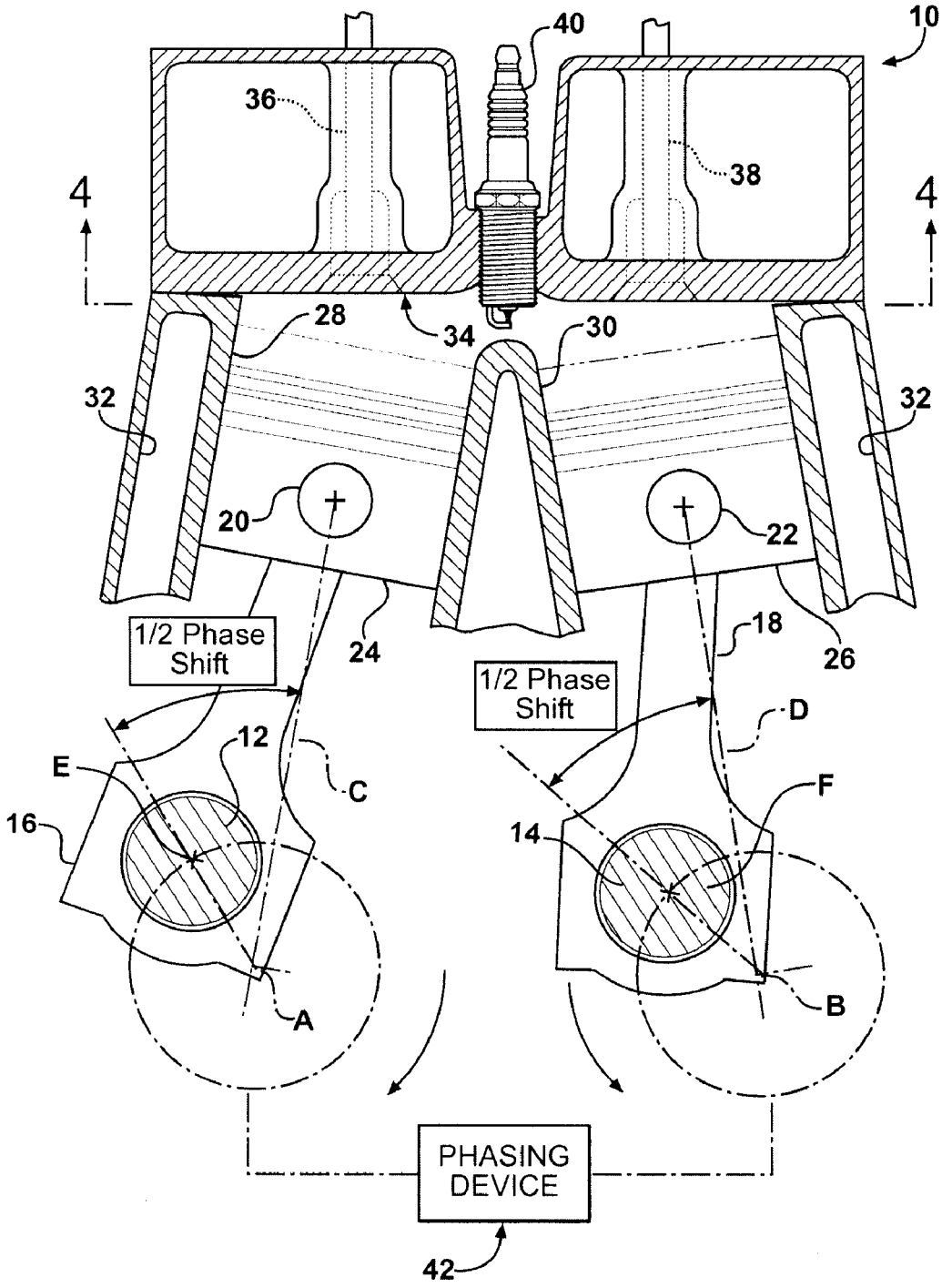
FIG. 3 is a view as in FIGS. 1 and 2 but depicting a further phase shift to 60 degrees.

FIG. 3 is yet a further example of the effect phase shifting will have wherein an exemplary phase shifted condition of 60 degrees is illustrated. In this example, the compression ratio for the engine, assuming the same parameters as previously set forth, reduces to 7.0:1. Of course, these parameters are used for exemplary calculations only and are not to be, in any way, considered limiting.

Figure 5:
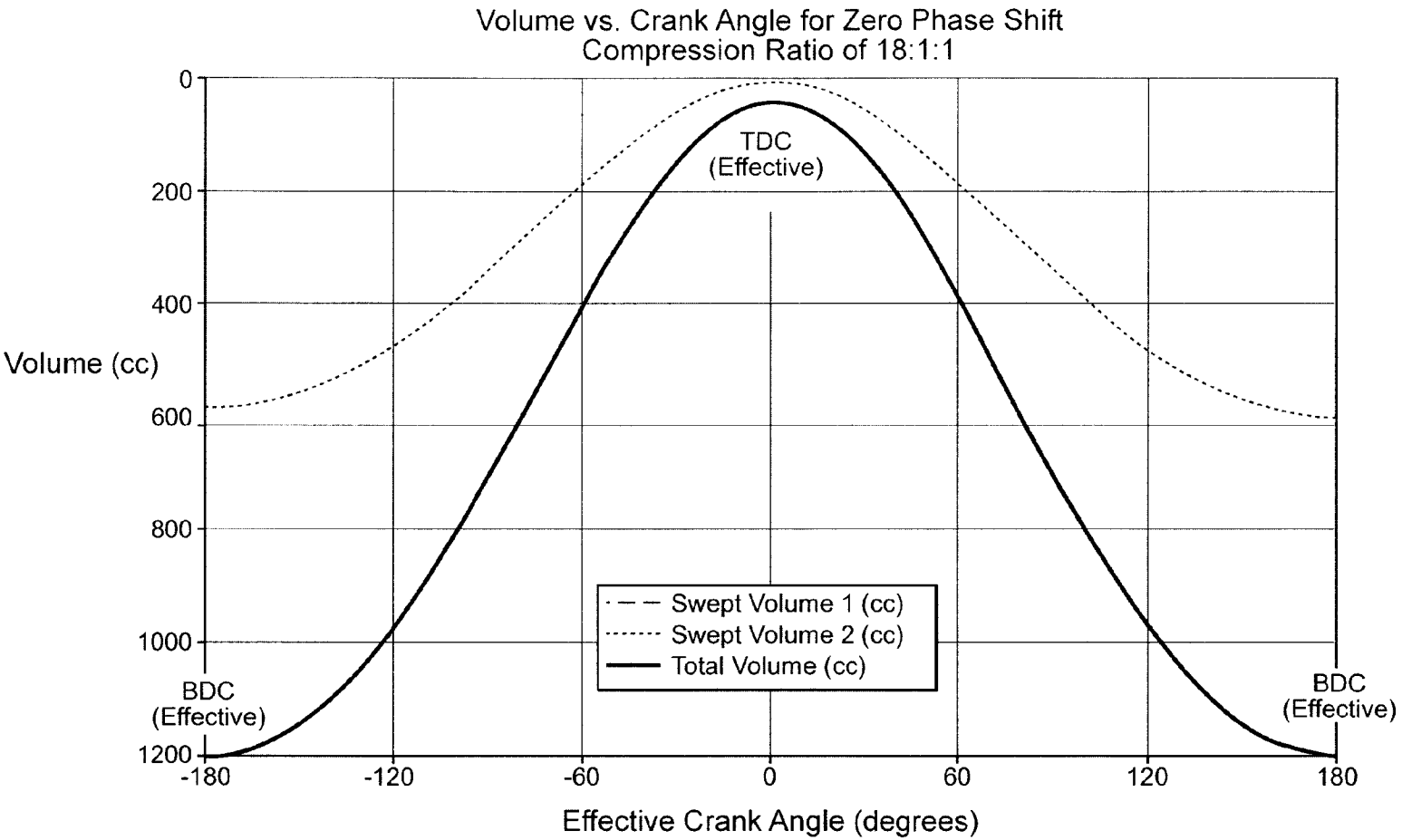
FIG. 5 is a chart plotting swept volume versus crank angle for the zero degree phase shift condition of the engine corresponding to the view in FIG. 1.
Figure 6:
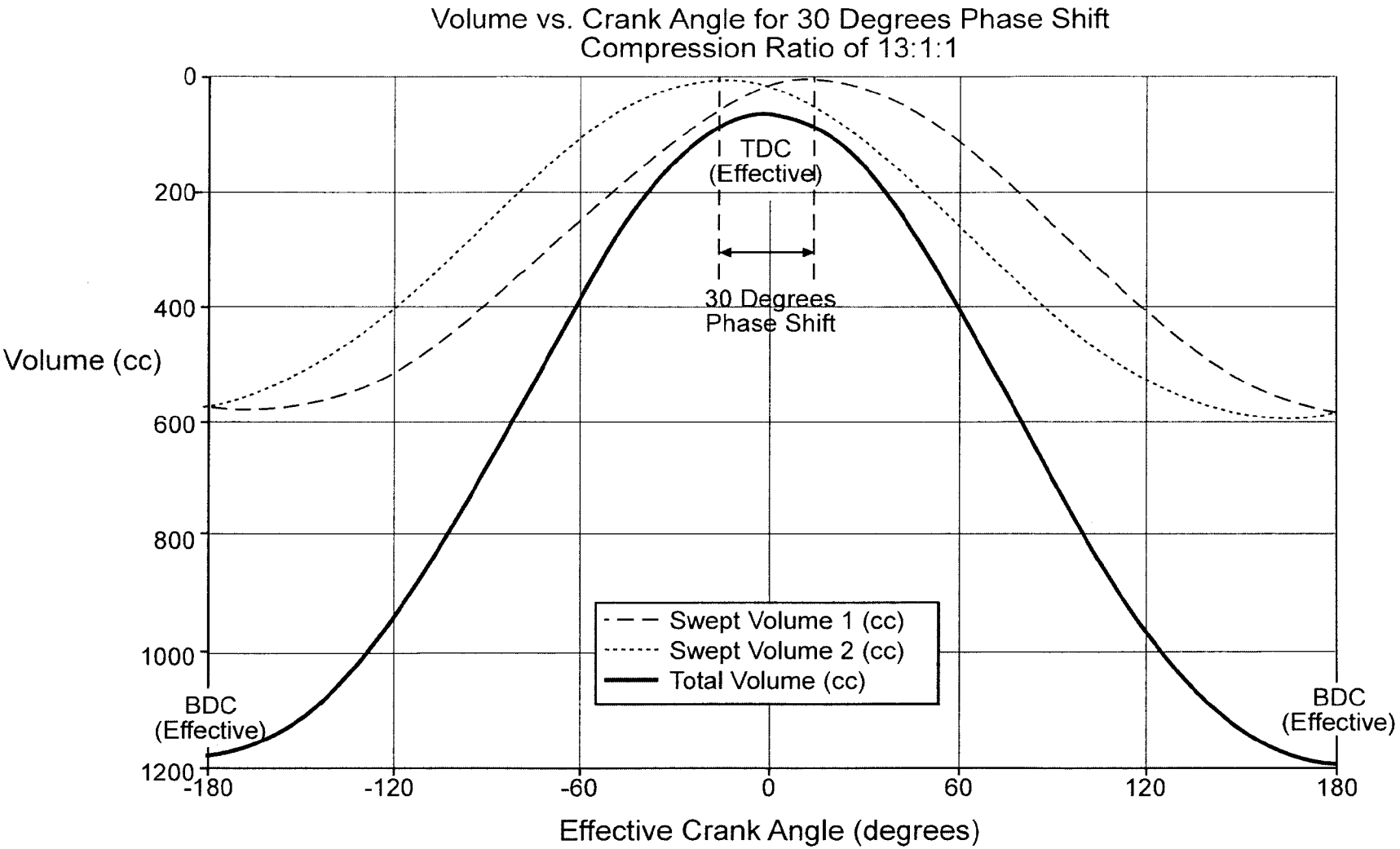
FIG. 6 is a chart as in FIG. 5 but representing a 30 degree phase shift between crankshafts corresponding to the view in FIG. 2.
Figure 7:
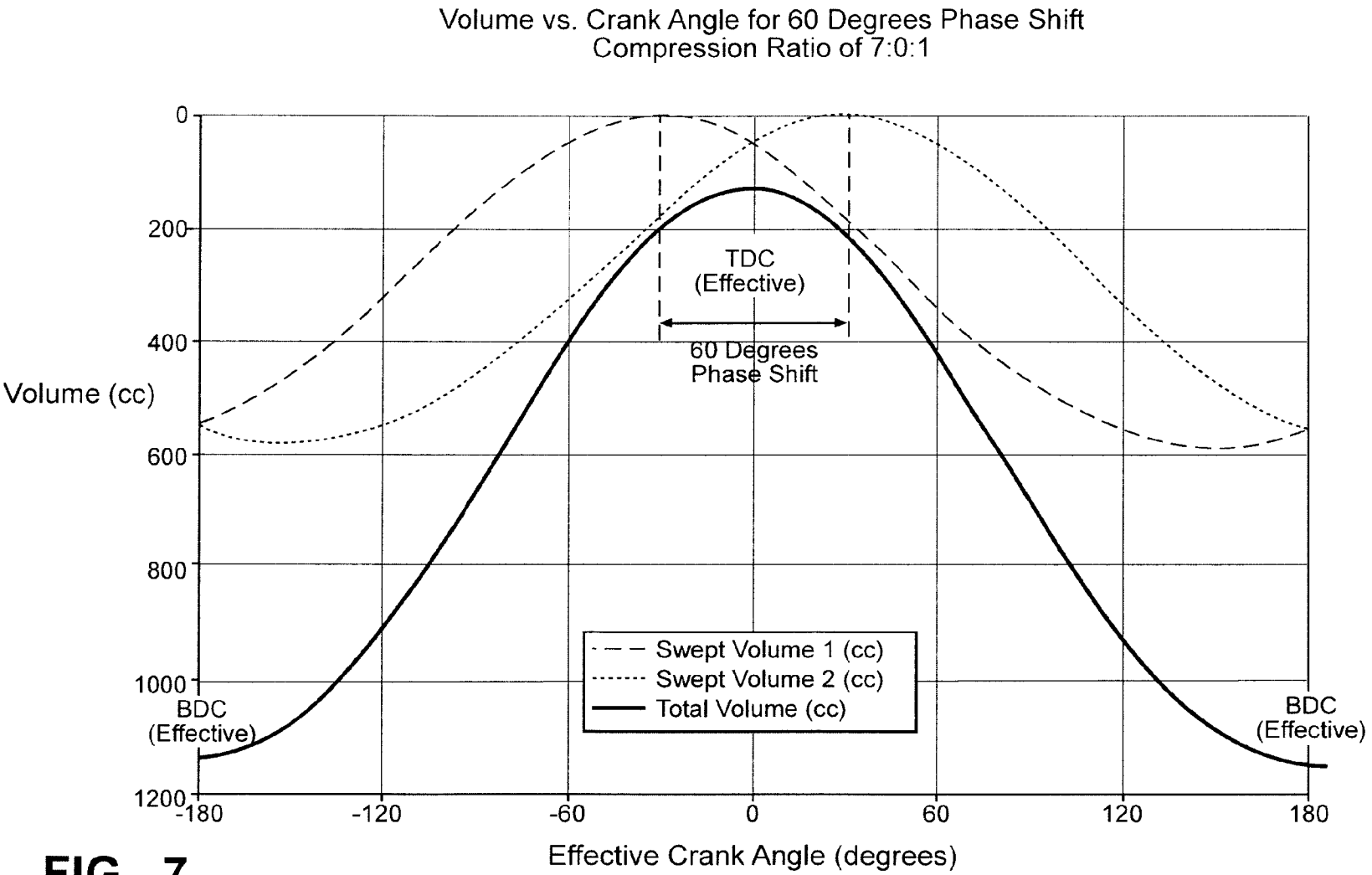
FIG. 7 is yet another chart as in FIG. 5 but depicting a 60 degree phase shift condition and corresponding to the view in FIG. 3.

FIGS. 5, 6 and 7 depict the total swept volume of the engine 10 for the respective zero, 30 degree and 60 degree phase shift conditions represented in FIGS. 1, 2 and 3, respectively. By comparing the curves plotted in FIGS. 5, 6 and 7, it will be apparent to those of skill in this art that the engine 10 exhibits an effective top dead center and an effective bottom dead center condition when the two cylinders have identical dimensional parameters and the phase shifting is equally divided, i.e., advance and retard, between the first 28 and second 30 cylinders. In other words, as shown in FIGS. 2 and 6, the effective top dead center condition for the engine 10 occurs when the first rod bearing center E is retarded 15 degrees and the second rod bearing center F is advanced 15 degrees. Thus, when the magnitudes of the advance and retard angular offsets are equivalent between each crank assembly, an effective top dead center or bottom dead center condition will occur.

Also evident by comparison to FIGS. 5-7, the total swept volume decreases as the phase shift increases. Swept volume may be represented by the equation:

$$\text{Swept Volume} = \text{BDC}_{(effective)}\ \text{Volume} - \text{TDC}_{(effective)}\ \text{Volume}$$

Figure 8:
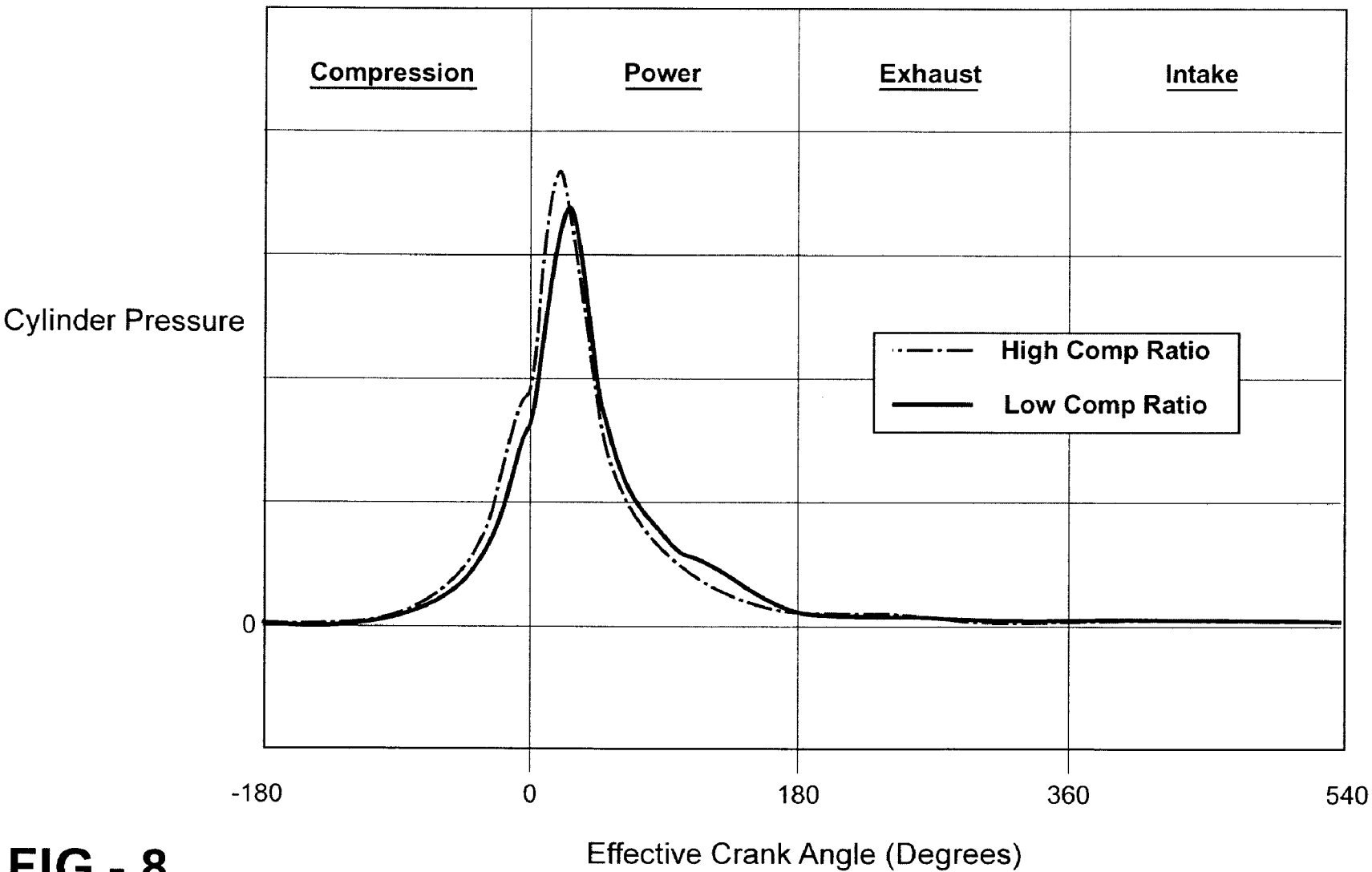
FIG. 8 represents engine cylinder pressure as developed through two complete revolutions of the crankshafts indicating a comparison between developed cylinder pressure when the engine is operated at high and low compression ratio settings, assuming that both curves represent the same speed and load conditions, with equal torque being produced.
Figure 9:
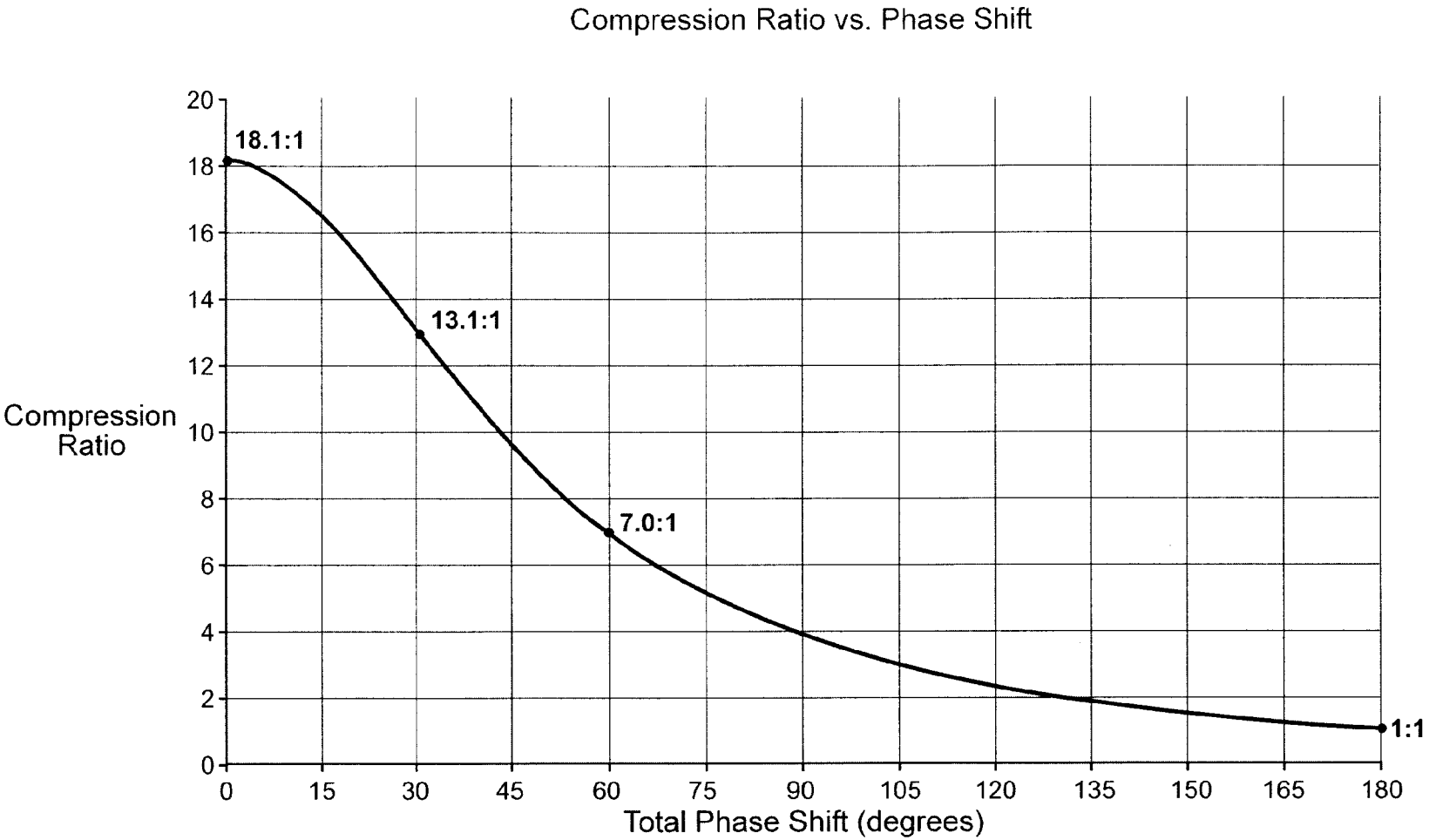
FIG. 9 is a graph illustrating the effect of crankshaft phase shift (in degrees) as a function of the developed compression ratio, with the greatest compression ratio being developed at zero degree phase shift and a 1:1 compression ratio being developed at 180 degrees phase shift.

Thus, the maximum swept volume for the engine 10 will occur at zero phase shift. This change in swept volume is functionally related to a change in the compression ratio. Reference is made to FIGS. 8 and 9. In FIG. 8, the total developed cylinder pressure as a function of crank angle (effective) is plotted for both zero phase shift and 30 degree phase shifted conditions. Here, it is instructive to note that with higher compression ratio, the maximum pressure and the temperature are both higher. This translates to better fuel efficiency. Likewise, with the higher expansion ratio, the pressure and temperature are lower when the exhaust valve opens, so that less energy is wasted by blow down across the exhaust valve. FIG. 9 plots the change in compression ratio as a function of phase shift. Thus, in the examples illustrated above in connection with FIGS. 1-3, a zero degree phase shift in this example translates into an engine compression ratio of 18.1:1. The 30 degree phase shift is indicative of a 13.1:1 compression ratio. And a 60 degree phase shift yields a 7.0:1 compression ratio for the engine 10. Extrapolation indicates that at 180 degrees total phase shift, the total swept volume will be zero and the resulting compression ratio will be 1:1.

In order to practically implement the teachings of this invention, a phasing device, generally indicated at 42 in FIGS. 1-3, is proposed for use with the engine 10. The phasing device 42 may be of any of the types of such devices known in the industry. Examples of phase shifting methods are illustrated in U.S. Pat. No. 2,858,816 to Prentice, U.S. Pat. No. 4,010,611 to Zachery, U.S. Pat. No. 4,902,957 to Tryhorn, and U.S. Pat. No. 6,230,671 to Achterberg, the entire disclosures of which are hereby incorporated by reference. Yet another phase shifting example can be found in Japanese Patent JP02004011546A to Yuji et al, published Jan. 15, 2004, the entire disclosure for which is hereby incorporated by reference. These examples illustrate some of but many techniques and methods for phasing parallel crankshafts on the fly. That is, the preferred phasing device 42 to be used in the subject invention is of the dynamic type which, while the engine 10 is operating, temporarily interrupts synchronized rotation between the two crankshafts 12, 14 to change the angular position of one crankshaft 12 relative to the other crankshaft 14, and then resumes synchronized rotation with the crankshafts 12, 14 in a new, phase-shifted condition relative to each other. Thus, any known techniques or even hereafter developed techniques for phasing the two crankshafts 12, 14 according to these principles may be incorporated for use as the phasing device 42 in this invention.

Figure 4:
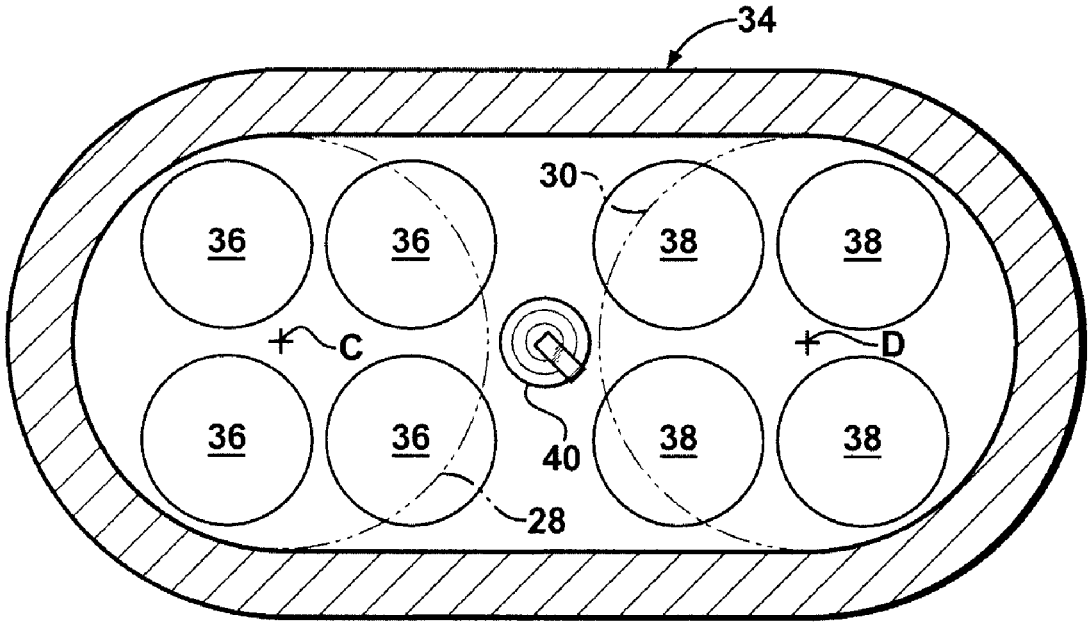
FIG. 4 is a simplified, exemplary view of the cylinder head taken generally along lines 4-4 in FIG. 3 and illustrating an imaginary extensions of each circular cylinder bore in broken lines.

Turning now to FIG. 4, a simplified view of the cylinder head 34 interior is depicted. In this illustrative depiction, the circular cross-section of each cylinder 28, 30 is represented by imaginary extensions projected onto the surface of the cylinder head 34. These imaginary extensions are represented by broken lines in FIG. 4. In this illustration, the intake 36 and exhaust 36 and intake 38 valves are shown to comprise each four separate poppet valves whose heads are shown as circles arranged about the cylinder head 34. Due to the enlarged cylinder head 34 area created by the space between the imaginary extension of the circular cross-sections of each cylinder 28, 30 projected on to the cylinder head 34, options are manifest with which to better optimize the volumetric efficiency of a variable compression ratio engine. One such option is illustrated by the fact that at least some of the valve heads are disposed partially outside of the imaginary extension of the circular cross-sections 28, 30 projected onto the cylinder head 34. This is real estate which is normally not available in a traditional-type piston and cylinder arrangement. However, because both cylinders 28, 30 share a common combustion chamber, the valves 36 and/or 38 can be extended into the common middle area. Additionally, the spark plug 40 can be located in this common middle area, thereby increasing the space available for the valves 36, 38 so that they can be made as large as possible. Of course, larger valves 36, 38 enhance an engine's breathing ability.

Another option which presents itself through the dual crankshaft arrangement of the subject invention 10, is the option to locate the exhaust 36 and intake 38 valves in unusual orientations. More specifically, when the engine 10 is operating at its maximum compression ratio, both pistons 24, 26 have identical motion and are in phase with each other. Thus, it makes no difference which side of the combustion chamber carries the exhaust valves 36 and which side carries the intake valves 38. However, when the engine 10 is operating at a lower compression ratio, such as when there is a sixty degree phase shift between the two crankshafts, the two pistons 24, 26 still have identical motion with each other, but the phase relationship is changed so that one piston 26 always leads and the other 24 always lags. Minimum combustion chamber volume, equivalent to a normal engine top dead center, has the leading piston already past its top dead center and on its way down its bore, while the lagging piston is an equal distance before its top dead center and still on its way up its bore. It follows, therefore, that it may be possible to position exhaust 36 and intake 38 valves relative to the leading and lagging piston conditions.

Figure 3A:
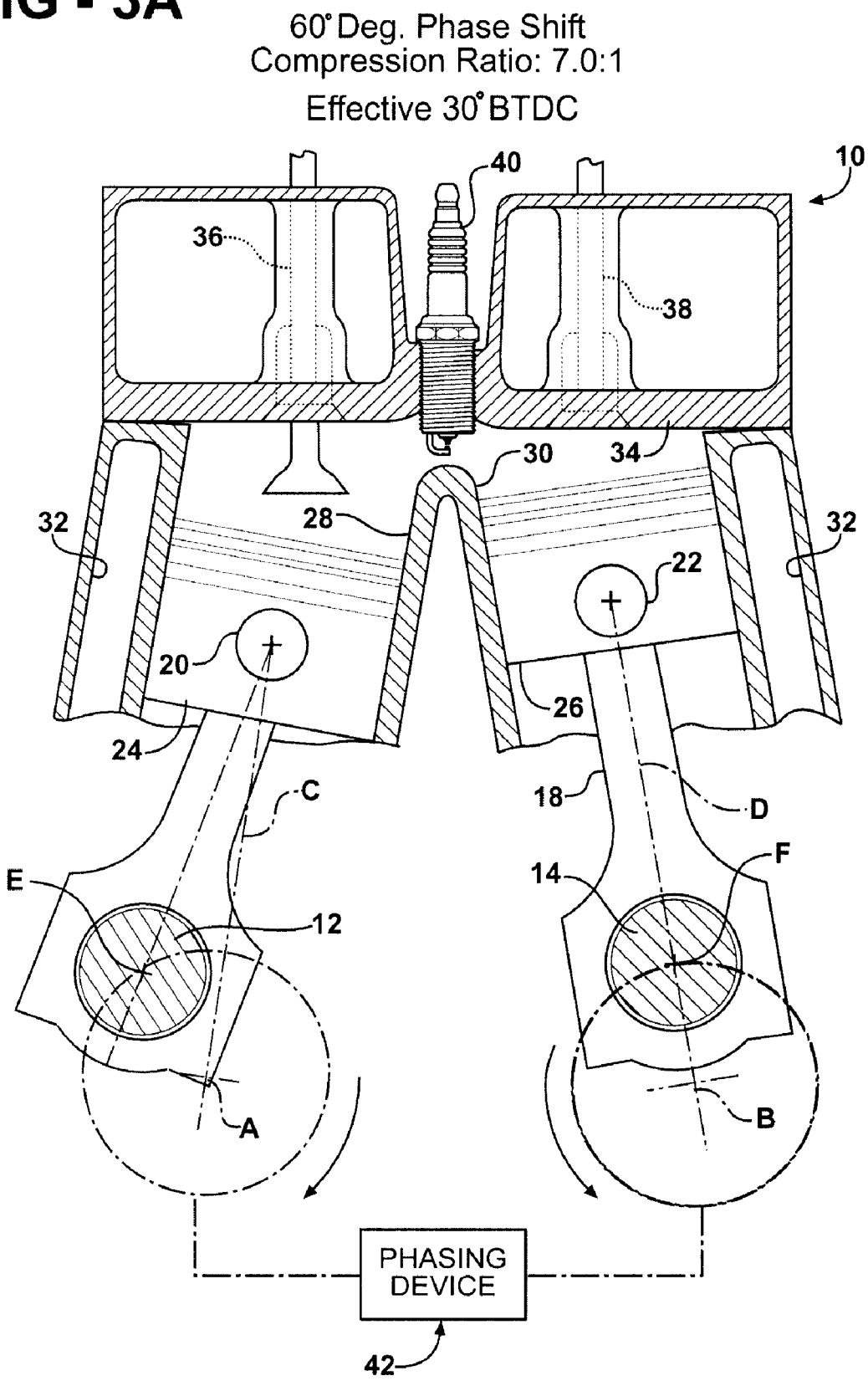
FIG. 3A is a view as in FIG. 3 with a 60 degree phase shift but depicting crankshaft rotational positions 30 degrees before the engine's effective top dead center.

Considering the exhaust valves 36, it is known that during the exhaust stroke, when the crankshafts' rotary positions are 30 degrees before the effective top dead center (TDC), the exhaust valves must be substantially open as illustrated in FIG. 3A. At this point in time, when the crankshafts are offset from each other by sixty degrees and the crankshafts' rotary positions are at an effective thirty degrees before effective TDC, the leading piston is at its TDC position and the lagging piston is at a lower position, sixty degrees before TDC. It will be obvious to a person skilled in the art of engine design that an exhaust valve may have insufficient clearance to the piston immediately below it if it is substantially open when that piston is at its top dead center position. Thus, the preferred location for the exhaust valves 36, to ensure adequate clearance to their corresponding piston, is above the lagging piston as illustrated in FIG. 3A.

Figure 3B:
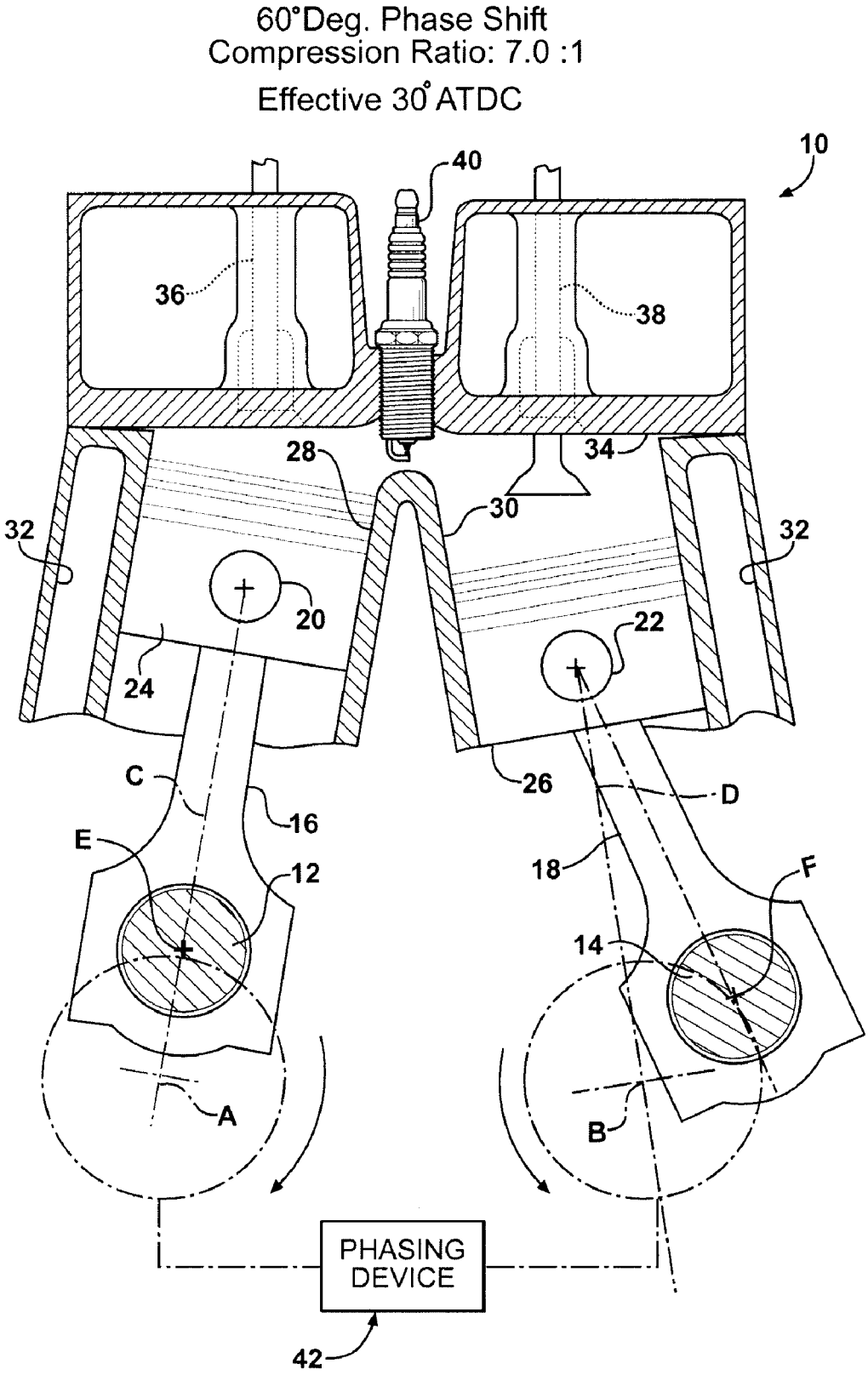
FIG. 3B is a view as in FIG. 3A but depicting crankshaft rotational positions 30 degrees after the engine's effective top dead center.

On the other hand, when the crankshafts are phased sixty degrees from each other and the rotary position is thirty degrees after the effective TDC, the leading piston is moving down its bore at a position of sixty degrees after its TDC and the lagging piston has just reached its TDC position. Since a substantial intake valve opening may be desired at 30 degrees after the engine's effective TDC, the preferred location for the intake valves 38 is above the leading piston as illustrated in FIG. 3B.

Each of the two rotating crankshafts, in conjunction with the reciprocating and rotating masses of their respective piston and connecting rod assemblies, may exhibit inertial unbalances such as pitching couples or vertical shaking forces in the vertical direction and yawing couples or lateral shaking forces in the horizontal direction. When the two crankshafts rotate in opposite directions and are close to being in phase with each other, the yawing couples and the lateral shaking forces tend to cancel each other while the vertical shaking forces and pitching couples add to each other. Thus, the overall engine will have the minimum unbalance when each half of the engine is balanced to minimize its vertical disturbances of shaking forces and pitching couples, even when doing so increases horizontal unbalance of that engine half.

The methods for carrying out this invention will be readily understood by the skilled artisan from the foregoing description and interrelationships between the various mechanical components and may find application to other piston machines such as diesel engines or pumps or compressors.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. In a dual crankshaft engine, wherein said crankshafts are supported for rotation about respective parallel axes, said engine comprising:

a pair of crankshafts supported for independent rotation about respective axes oriented parallel to each other;

first and second cylinders, each said cylinder associated with a different one of said crankshafts;

a piston disposed for reciprocating movement in each of said first and second cylinders;

a connecting rod pivotally connected at an upper end thereof to each said piston and at an opposite, lower end thereof to a respective one of said crankshafts;

a common cylinder head communicating simultaneously with said first and second cylinders, said cylinder head including at least one moveable intake valve and one moveable exhaust valve and a spark plug;

a phasing device interconnecting said crankshafts;

said phasing device synchronizing rotation of said crankshafts and selectively operable to temporarily interrupt synchronized rotation so as to change the angular position of one said crankshaft relative to the other said crankshaft and then resume synchronized rotation with said crankshafts in a new, phase-shifted condition relative to each other, whereby said phasing device can dynamically vary the compression ratio developed by said engine by altering the phase shift between said synchronized crank shafts;

said first and second cylinders defining respective longitudinal centerlines, wherein each said centerline perpendicularly intersects the rotational axis of the respective one of said crankshafts, and wherein the spacing between said centerlines varies as a function of distance from said crankshaft axes; and wherein the spacing between said longitudinal centerlines is greater adjacent said crankshaft axes and lesser adjacent said cylinder head; and wherein each of said first and second cylinders define a circular cross-section centered along said respective longitudinal axis, and wherein at least one of said intake and exhaust valves is disposed partially outside of an imaginary extension of said circular cross-section projected onto said cylinder head.

2. The engine of claim 1 wherein said spark plug is disposed outside of the imaginary extensions of said circular cross-sections for each of said first and second cylinders.

3. The engine of claim 1 wherein the imaginary extensions of said circular cross-sections for each of said first and second cylinders do not intersect each other when projected onto said cylinder head.

4. The engine of claim 1 wherein said first and second cylinders define respective longitudinal centerlines, wherein each said centerline is perpendicularly offset from the rotational axis of the respective one of said crankshafts, and wherein the spacing between said centerlines varies as a function of distance from said crankshaft axes.

5. The engine of claim 4 wherein the spacing between said longitudinal centerlines is greater adjacent said crankshaft axes and lesser adjacent said cylinder head.

6. The engine of claim 5 wherein each of said first and second cylinders define a circular cross-section centered along said respective longitudinal axis, and wherein at least one of said intake and exhaust valves is disposed partially outside of an imaginary extension of said circular cross-section projected onto said cylinder head.

7. The engine of claim 6 wherein said spark plug is disposed outside of the imaginary extensions of said circular cross-sections for each of said first and second cylinders.

8. The engine of claim 6 wherein the imaginary extensions of said circular cross-sections for each of said first and second cylinders do not intersect each other when projected onto said cylinder head.

9. A method for varying the compression ratio of an internal combustion engine having dual crankshafts supported for rotation about respective parallel axes, said method comprising the steps of:

providing first and second cylinders, each cylinder associated with a different crankshaft;

providing a pair of pistons;

disposing one piston in each of the first and second cylinders for reciprocating movement;

pivotally connecting each piston to a respective one of the crankshafts with a connecting rod so that the piston reciprocates a full up and down stroke in its respective cylinder with each crankshaft revolution;

enclosing the first and second cylinders with a common cylinder head so that combustion gasses communicate between the first and second cylinders;

moveably supporting at least one intake valve and one exhaust valve in the cylinder head;

supporting a spark plug in the cylinder head;

synchronizing rotation of the crankshafts;

temporarily interrupting said synchronizing rotation to change the angular position of one crankshaft relative to the other crankshaft;

resuming said synchronizing rotation with the crankshafts in a new, phase-shifted condition relative to each other, whereby said temporarily interrupting and said resuming can be used to selectively dynamically vary the compression ratio developed by the engine by altering the phase shift between the synchronized crankshafts; and wherein the first and second cylinders define respective longitudinal centerlines, each centerline perpendicularly offset from the rotational axis of the respective one of the crankshafts, further including the step of varying the spacing between the longitudinal centerlines as a function of distance from the crankshaft axes.

10. The method of claim 9 wherein the first and second cylinders define respective longitudinal centerlines, each centerline perpendicularly intersecting the rotational axis of the respective one of the crankshafts, further including the step of varying the spacing between the longitudinal centerlines as a function of distance from the crankshaft axes.

11. The method of claim 9 wherein said step of varying the spacing between the longitudinal centerlines includes maintaining the spacing greatest adjacent the crankshaft axes and least adjacent the cylinder head.

12. The method of claim 9 wherein said step of pivotally connecting each piston to a respective one of the crankshafts with a connecting rod includes establishing a rotational axis between a lower end of each connecting rod and the crankshaft, and wherein each connecting rod experiences a dead center condition each time its crank pin axis crosses the line connecting the piston pin axis to the main bearing axis.

13. The method of claim 12 further including the step of determining an effective engine dead center by identifying the moment at which the connecting rods are equidistantly angularly spaced from their respective dead center conditions.

14. The method of claim 13 wherein said step of synchronizing rotation of said crankshafts includes achieving a maximum engine compression ratio by controlling each of the connecting rod dead center conditions to occur simultaneously with the effective engine dead center.

15. The method of claim 13 wherein said step of synchronizing rotation of said crankshafts includes achieving a minimum engine compression ratio by angularly spacing each of the connecting rod dead center condition 180 degrees apart from the other connecting rod dead center condition.

* * * * *